US005616105A

United States Patent [19]

Wang et al.

[11] Patent Number: 5,616,105

[45] Date of Patent: Apr. 1, 1997

[54] ROWING MACHINE

[75] Inventors: Leao Wang; Peter Wu, both of Taichung Hsien, Taiwan

[73] Assignee: Greenmaster Industrial Corp., Taichung Hsien, Taiwan

[21] Appl. No.: 594,685

[22] Filed: Jan. 29, 1996

[51] Int. Cl.[6] ..... A63B 21/00

[52] U.S. Cl. ..... 482/72; 482/95; 482/96

[58] Field of Search ..... 482/72, 95, 96, 482/57, 71, 111; 472/106, 110; 280/1.182, 1.183, 1.192, 1.205, 1.204

[56] References Cited

U.S. PATENT DOCUMENTS 5,342,269 8/1994 Huang et al. ..... 482/95
5,442,518 2/1996 Meason ..... 482/72
5,507,709 4/1996 Wu ..... 482/72
5,512,027 4/1996 Chen ..... 482/72
5,527,243 6/1996 Chen ..... 482/72
5,533,953 7/1996 Lui et al. ..... 482/72

*Primary Examiner*—Jerome Donnelly
*Attorney, Agent, or Firm*—Bacon & Thomas

[57] ABSTRACT

The exercising action of a rowing machine handle may be changed from pulling to pushing by relocating the front end of a link plate, having its rear end pivotally connected to the handle, from an upper position to a lower position on a pair of blocks mounted to a pivotal foot pedal.

2 Claims, 3 Drawing Sheets

ROWING MACHINE

BACKGROUND OF THE INVENTION (a) Field of the Invention

The present invention relates generally to a rowing machine, and more particularly to an improved rowing machine in which the direction of action of the rowing machine may be adjusted with ease to accommodate the needs of the user.

(b) Description of the Prior Art

Various kinds of exercising apparatuses, such as steppers, exercise bikes and rowing machines are known in the art. To cater to users of different needs, it will be necessary to provide an exercising machine with new and improved functions.

SUMMARY OF THE INVENTION

Accordingly, it is a primary object of the present invention to provide an improved rowing machine in which the direction of action of the rowing machine may be easily adjusted to suit the needs of the user.

In order to accomplish the above-mentioned object, a rowing machine of the present invention comprises a base frame, a main frame, a pedal means, a handle means and an adjusting means. The main frame is pivotally provided on a front stem of the base frame, and a curved arm of the handle means is insertably connected to the main frame at a pre-determined position for pulling or pushing purposes. A link piece is provided on either side of the curved arm on the main frame. A saddle and a back rest are respectively disposed on the main frame at a rear end portion thereof. The base frame further consists of two support bars extending from the front stem with an angle bar disposed between the two support bars. The pedal means is pivotally connected to the angle bar and consists of two parallel curved stems with a pulley capable of displacement under the main frame disposed therebetween. A linking-up plate has one end thereof pivotally connected to a couple of blocks respectively located at the lower portion of the curved stems and the other end thereof pivotally connected to the link pieces on the curved arm. The adjusting means, configured to resemble a jaw, has a front section thereof joined to the ends of threaded rod which pivotally connects the linking-up plate and the curved stems. The threaded rod is also provided with a couple of positioning buttons and springs. By means of this arrangement, action of the rowing machine may be adjusted with ease to suit the needs of the user.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
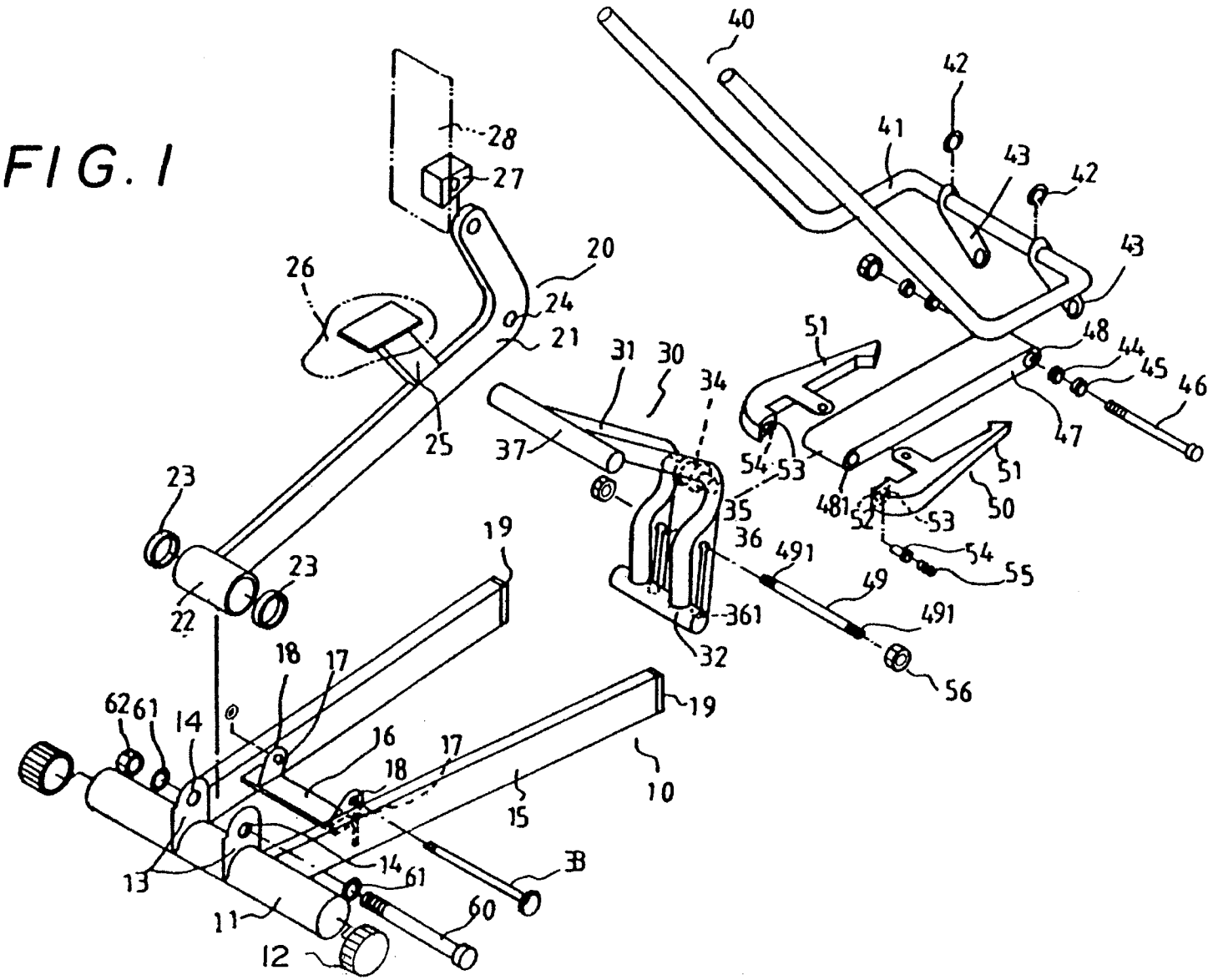
FIG. 1 is an exploded, elevational view of a preferred embodiment of the improved rowing machine according to the present invention.
Figure 2:
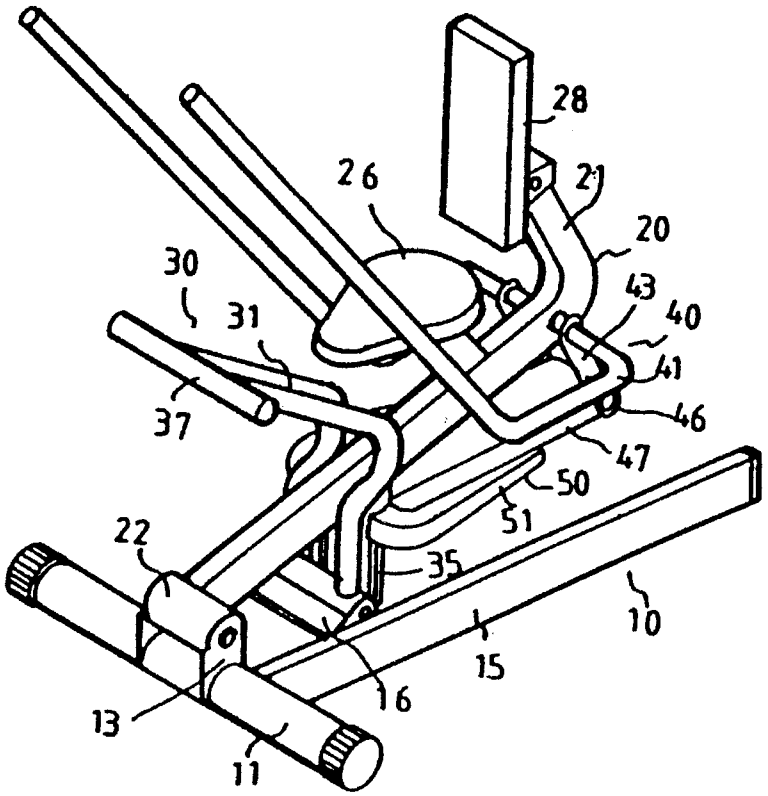
FIG. 2 is an elevational view of the preferred embodiment of the rowing machine of the present invention in an assembled state.

With reference to FIGS. 1 and 2, a preferred embodiment of the rowing machine according to the present invention essentially comprises a base frame 10, a main frame 20, a pedal means 30, a handle means 40 and an adjusting means 50.

The base frame 10 consists of a front stem 11 having either end thereof fitted with a plastic cap 12 and two corresponding lugs each having a pivot hole 18 disposed on a top side thereof. The base frame 10 further consists of two support bars 15 which extend from one side of the front stem 11 such that the two support bars 15 are farthest apart from each other at their respective free ends which are fitted with plastic caps 19 respectively. An angle bar 16 is disposed between the two support bars 15 at a suitable position. The angle bar 16 is provided with two lugs 17 each having a mounting hole 18 on an upper side thereof.

As shown in FIGS. 1 and 2, the main frame 20 consists of a substantially L-shaped main bar 21 which has a hollow tube 22 provided at a front end of a longer section thereof such that the main bar 21 is substantially perpendicular to the hollow tube 22. The hollow tube 22 has either end thereof fitted with a packing sleeve 23. The hollow tube 22 along with its packing sleeves 23 is arranged between the two lugs 14 on the front stem 11 of the base frame 10. A bolt 60 having either end thereof fitted with a washer 61 is inserted through the hollow tube 22 to secure the hollow tube 22 between the lugs 14 with a nut 62 locking a threaded end thereof to restrict and position the hollow tube 22 on the front stem 11. The main bar 21 may then turn with the hollow stem 22 as its pivot. The main bar 21 is further provided with a through hole 24 at a pre-determined position near its bend. A seat bar 25 having a saddle 26 fixed disposed on an upper end thereof is also fixed connected to the main bar 21 at a pre-determined position. Besides, a rotary seat 27 having a back rest 28 fixedly provided on an upper end thereof is pivotally connected to a rear end thereof.

The pedal means 30 is mounted on the angle bar 16. It is consisted of two parallel curved stems 31 connected to a pivot tube 32 at their bottom ends. The pivot tube 32 is disposed between the lugs 17 of the angle bar 16, and a bolt 33 is used to pass through the respective connecting holes 18 of the lugs 17 of the angle bar 16 to secure the pivot tube 32 between the lugs 17. A pulley 34 is disposed intermediate the two curved stems 31 for slidable displacement along a bottom side of the main frame 20. A block 35 is further provided at a lower rear side of each curved stem 31. Each block 35 has a first positioning hole 36 and a second positioning hole 361. A pedal bar 37 is further disposed at a top end of the curved stems 31.

The handle means 40 is consisted of a substantially U-shaped curved arm 41 which has a middle section thereof passing through the through hole 24 of the main frame 20 with a couple of C-clips 42 located at either side of the middle section inserted through the through hole 24 for restricting the displacement thereof, such that the curved arm 41 may be pulled forwardly or backwardly. Two link pieces 43 each having a hole at an end thereof are disposed on either side of the middle section of the curved arm 41 inserted through the through hole 24 of the main frame 20.

The link pieces 43 are respectively connected to a rear end portion of a linking-up plate 47 provided with a first through pivot hole 48 at the rear end portion thereof. The linking-up plate 47 is arranged with its rear end portion between the two link pieces 43, and a bolt 46 fitted with a couple of packing sleeves 44 and washers 45 is passed through the respective holes of the link pieces 43 and the pivot holes 48 of the linking-up plate 47 with a nut 451 locked to a threaded end thereof for positioning the linking-up plate 47. The linking-up plate 47 further has a second through pivot hole 481 at a front end portion thereof, and a rod 49 with a threaded section 491 at either end thereof is used to position the front end portion of the linking-up plate 47 between the positioning slots 36 of the curved stems 31.

The adjusting mechanism 50 consists of a couple of adjusting arms 51 in the shape resembling a jaw, each of which has a middle section thereof pivotally connected to a bottom side of the linking-up plate 47. A front end section of each adjusting arm 51 is configured to bend inwardly to form a projection 52 having a retain hole 53 provided with a projecting positioning button 54 thereon. The front end sections of the adjusting arms 51 along with their positioning buttons 54 are then respectively fitted onto the threaded sections 491 of the rod 49 with a spring 55 inserted onto either end thereof. A couple of nuts 56 are then locked onto the respective threaded sections 491. Under normal conditions, the positioning buttons 54 are urged against by the springs 55 to project into the first positioning holes 36 of the curved stems 31.

Figure 3:
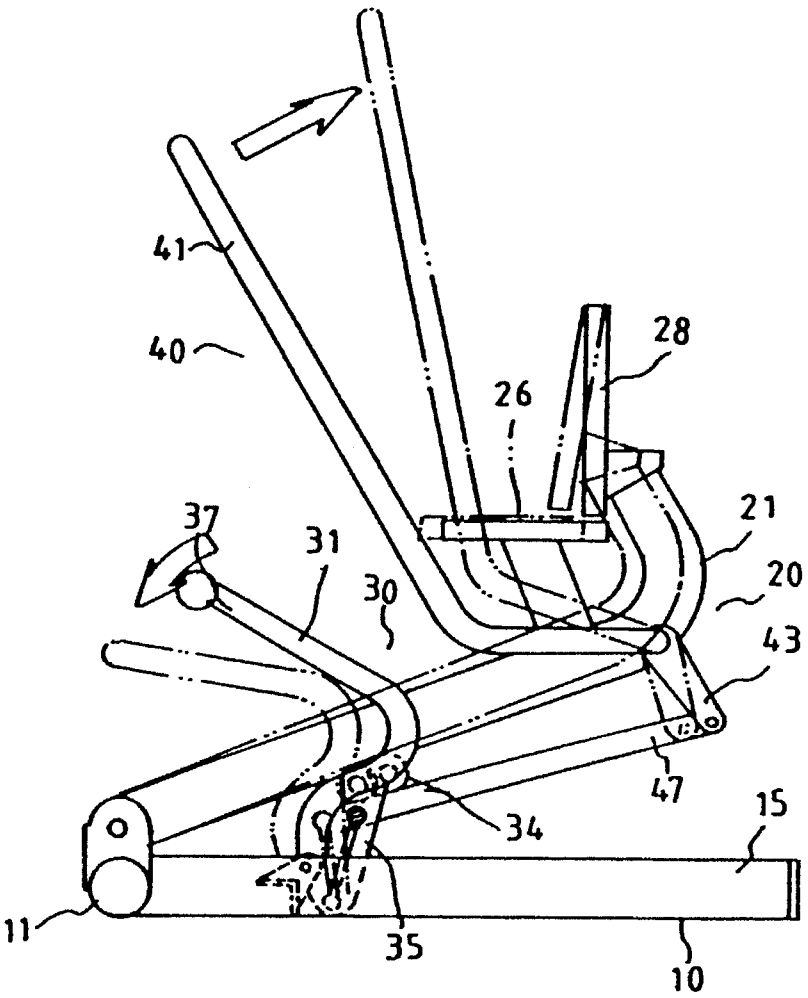
FIG. 3 is a schematic side view illustrating operation of the rowing machine.

Referring to FIG. 3, in actual use, a user is seated on the saddle 26 and pulls both ends of the curved arm 41 backwardly (towards the body), causing the link pieces 43 on the curved arm 41 to displace forwardly, bringing the linking-up plate 47 to advance forwardly. At the same time, with the user's feet pushing the pedal bar 37 with force, the pulley 34 intermediate the curved stems 31 will slide along the bottom side of the main frame 20, pushing the main frame 20 to displace forwardly, while the linking-up plate 47 pivotally connected to the blocks 35 of the curved stems 31 is caused to advance forwardly due to the forward displacement of the pedal means 30. Hence, the user seated on the saddle 26 may be pushed forwardly up.

Figure 4:
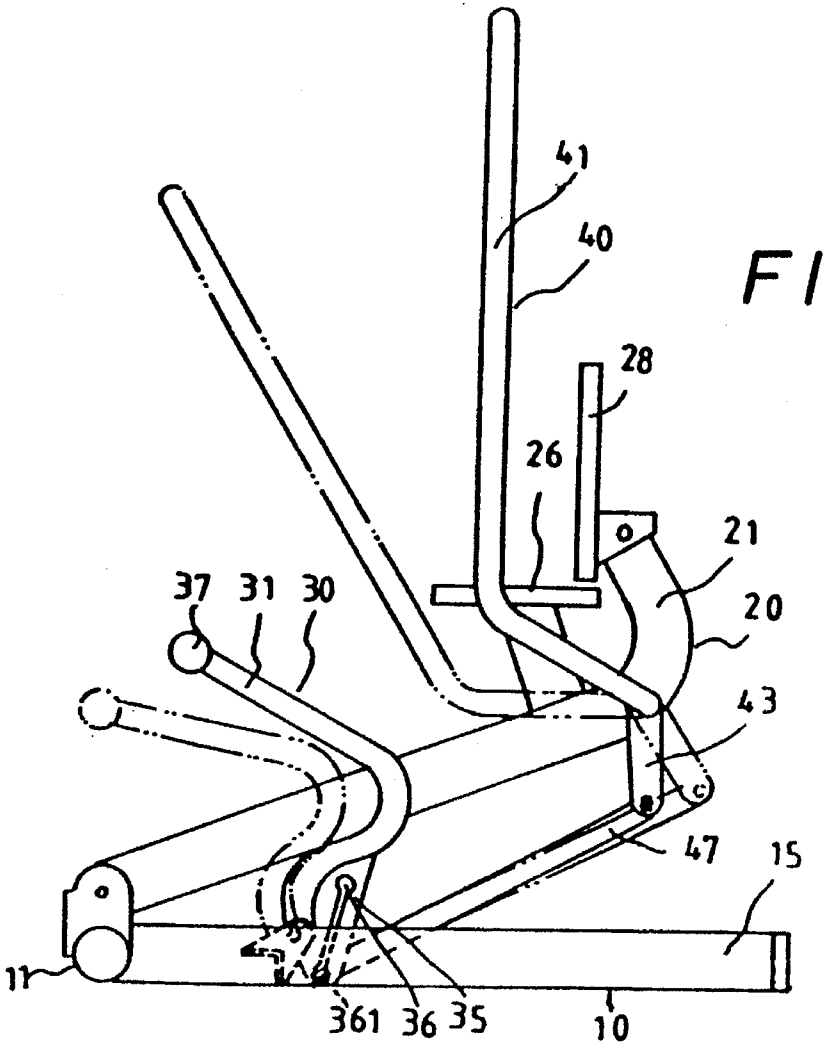
FIG. 4 is another schematic side view illustrating operation of the rowing machine.

Furthermore, with reference to FIG. 4, the linking-up plate 47 may be arranged to be pivotally joined to the blocks 35 of the curved stems, 31 at the second positioning holes 361 at the bottom end of the elongated slots. In this way, when the curved arm 41 is pushed forwardly, the link pieces 43 will displace backwardly, bring the linking-up plate 47 to displace backwardly. When the user pushes the pedal bar 37, the main frame 20 as well as the saddle 26 on which the user is seated will be caused to displace forwardly up.

Figure 5:
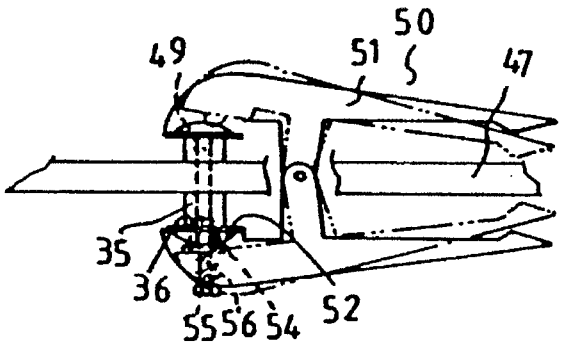
FIG. 5 is a schematic view illustrating operation of the adjusting means of the preferred embodiment of the rowing machine of the present invention.

In regard to the adjustment of the relationship between the linking-up plate 47 and the pedal means 30, reference is made to FIG. 5. By pressing the rear sections of the adjusting arms 51 inwardly, the projections 52 are caused to open outwardly so that the positioning buttons 54 are disengaged from the first positioning holes 36 or the second positioning holes 361 of the blocks 35 of the curved stems 31. After the height of the linking-up plate 47 has been adjusted, the pressure exerted at the rear sections of the adjusting arms 51 may be released so that the positioning buttons 54 may be urged by the springs 55 to project into the first positioning holes 36 or the second positioning holes 361 of the blocks.

In view of the aforesaid, the rowing machine according to the present invention provides a novel structure to allow the user to perform forward or backward pulling motions and to permit the user to speedily adjust the direction of action of the rowing machine.

Although the present invention has been illustrated and described with reference to the preferred embodiment thereof, it should be understood that it is in no way limited to the details of such embodiment but is capable of numerous modifications within the scope of the appended claims.

What is claimed is:

1. A rowing machine comprising:

a) a base frame including a front stem, a pair of support bars extending rearwardly of the front stem, a first lug means on the front stem, an angle bar disposed between the support bars and a second lug means on the angle bar;

b) a main frame including a main bar, a connecting tube at a front end of the main bar, the connecting tube being pivotally connected to the first lug means, a hole formed through the main bar, and a seat means mounted on the main bar;

c) a pedal means including a pair of curved stems, a pivot tube carried at a bottom portion of the curved stems, the pivot tube being pivotally connected to the second lug means, a pulley disposed intermediate the curved stems for sliding displacement along a bottom side of the main bar, a block provided at a rear side of each curved stem, each block including an upper positioning hole and a lower positioning hole, and a pedal bar joining the curved stems at a top portion thereof for engagement by the feet of a user;

d) a handle means including a curved arm having a middle section, the middle section being pivotally engaged through the hole of the main bar, a pair of links mounted on opposite sides of the middle section, a linking plate having a front end and a rear end, each link including a free end pivotally connected to the rear end of the linking plate, the front end of the linking plate being connected to the blocks for movement between the upper and lower positioning holes thereof; and e) an adjusting means including a pair of arms pivotally connected to a bottom side of the linking plate, each arm including an inwardly directed front section, projection means carried by each front section for selective engagement within either the upper positioning holes or the lower positioning holes of the block for respectively permitting a user to impart a pulling action or a pushing action to the curved arm of the handle means.

2. The rowing machine of claim 1 further including:

a) the front end of the linking plate having a hole therethrough;

b) a rod including a pair of oppositely threaded ends extending through the hole of the linking plate; and c) the projection means at the front section of each adjusting arm including a projection having a retaining hole, a positioning button disposed at the retaining hole and spring means for urging the positioning button into a selected positioning hole.

* * * * *